US010514218B2

(12) United States Patent
Afshari

(10) Patent No.: US 10,514,218 B2
(45) Date of Patent: Dec. 24, 2019

(54) FIREARM AND METHOD OF FORMING CHANNELS TO CONTAIN COMPRESSIBLE MATERIAL

(71) Applicant: 03312004 LLC, Gilbert, AZ (US)

(72) Inventor: Thomas Afshari, Gilbert, AZ (US)

(73) Assignee: 03312004 LLC, Gilbert, AZ (US)

( * ) Notice: Subject to any disclaimer, the term of this patent is extended or adjusted under 35 U.S.C. 154(b) by 0 days.

(21) Appl. No.: 15/990,217

(22) Filed: May 25, 2018

(65) Prior Publication Data

US 2019/0360770 A1 Nov. 28, 2019

(51) Int. Cl.
*F41A 3/66* (2006.01)
*F41A 3/74* (2006.01)

(52) U.S. Cl.
CPC . *F41A 3/66* (2013.01); *F41A 3/74* (2013.01)

(58) Field of Classification Search
CPC ..... F41A 3/66; F41A 3/74; F41A 11/00
USPC ..... 42/75.01, 75.02, 75.03, 75.04
See application file for complete search history.

(56) References Cited

U.S. PATENT DOCUMENTS 6,487,805 B1 * 12/2002 Reynolds ..... F41A 21/485 42/75.03
6,889,462 B1 * 5/2005 Carlson ..... F41C 27/22 42/75.01
8,397,414 B2 * 3/2013 Walters ..... F41C 23/04 42/71.01
8,806,792 B2 * 8/2014 Yan ..... F41C 23/16 42/71.01
8,881,444 B2 * 11/2014 Warburton ..... F41A 11/00 42/74
9,038,771 B1 * 5/2015 Mueller ..... F41A 21/30 181/223
9,791,223 B2 * 10/2017 Anderson ..... F41A 17/56
2011/0088306 A1 * 4/2011 Nasef ..... H02G 3/0493 42/136
2011/0203449 A1 * 8/2011 Ardiff ..... B32B 5/28 89/36.02
2013/0055610 A1 * 3/2013 Watkins ..... F41A 11/04 42/16

(Continued)

OTHER PUBLICATIONS

Quality O Rings found for the "o ring trick", https://www.ar15.com/forums/ar-15/Quality_o_rings_found_for_the_o_ring_trick/118-646828/, 11 pages, May 16, 2014.

*Primary Examiner* — Joshua E Freeman
(74) *Attorney, Agent, or Firm* — Robert D. Atkins; Patent Law Group: Atkins and Associates, P.C.

(57) ABSTRACT

A firearm has a lower receiver with a first channel formed in a first surface of the lower receiver, and an upper receiver attached to the lower receiver at a pivot point. A compressible material is disposed within the first channel between the upper receiver and lower receiver. The upper receiver compresses the compressible material when the upper receiver closes onto the lower receiver. A recess can be formed within the first channel and extends into the lower receiver deeper than the first channel. A second channel is formed in a second surface of the lower receiver. Alternatively, the lower receiver has a slot formed in a surface of the lower receiver, and the compressible material is disposed within the slot. The slot includes a bottom surface and vertical surface extending from the bottom surface to the surface of the lower receiver, and rounded ends.

17 Claims, 17 Drawing Sheets

(56) References Cited

U.S. PATENT DOCUMENTS

| | | | | |
|---|---|---|---|---|
| 2015/0247688 | A1* | 9/2015 | Zonshine | F41A 3/68<br>42/8 |
| 2016/0298916 | A1* | 10/2016 | Anderson | F41A 17/56 |
| 2017/0299292 | A1* | 10/2017 | Daley, Jr. | F41A 11/00 |
| 2018/0106567 | A1* | 4/2018 | Meyers | F41A 17/38 |
| 2018/0128562 | A1* | 5/2018 | Carsey | F41A 17/38 |
| 2018/0135928 | A1* | 5/2018 | Longueira | F41A 11/04 |
| 2018/0313618 | A1* | 11/2018 | Timmons | F41A 3/66 |
| 2019/0039192 | A1* | 2/2019 | Smith | B23Q 3/00 |

* cited by examiner

FIREARM AND METHOD OF FORMING CHANNELS TO CONTAIN COMPRESSIBLE MATERIAL

FIELD OF THE INVENTION

The present invention relates in general to firearms and, more particularly, to a firearm and method of forming a channel or slot in the lower receiver and using compressible material to improve fit, function, accuracy, reliability, and durability of the firearm.

BACKGROUND

Modern firearms are designed and manufactured to operate with multiple interoperational components and often with modular construction. In one example, an AR-10 or AR-15 style sporting rifle 100 uses a modular construction with an upper receiver 102 and lower receiver 104, as shown in FIG. 1*a*. Lower receiver 104 is characterized by trigger guard 106, trigger assembly with hammer 108, pistol grip 110, and magazine well 112. Buttstock 114 attaches to lower receiver 104. Upper receiver 102 is characterized by bolt carrier assembly, forward assist, charging handle, and gas-operated reloader. Barrel assembly 120 with handguard 122 attaches to upper receiver 102. Lower receiver 104 is attached to upper receiver 102 by removable rear take-down pin 124 and forward pivot pin 126. Removing rear take-down pin 124 allows upper receiver 102 to hinge and rotate about forward pivot pin 126, see FIG. 1*b*.

The AR-15 platform is designed to have clearance fit/free running between lower receiver 104 and upper receiver 102. The standard tolerances between upper receiver 102 and lower receiver 104 causes the upper and lower receiver to not fully interlock. When AR-15 100 is fully assembled with upper receiver 102 engaging lower receiver 104 and pins 124-126 in place, as in FIG. 1*a*, there remains some gap or space between the upper receiver and lower receiver, given design and machining tolerances. In other words, upper receiver 102 and lower receiver 104 engage with a loose fit. The tolerances are necessary for free running assembly and dis-assembly of the firearm. If the tolerances are too tight, the lower receiver and the upper receiver will jam, improper fit, or difficulty with assembly and disassembly. In addition, the space leads to movement of upper receiver 102 relative to lower receiver 104 during firing, malfunction of the firearm, cartridge jams, and reduced targeting accuracy. Some manufacturers may have loose tolerances and low manufacturing quality control with respect to fitment between upper receiver 102 and lower receiver 104. The jamming and malfunction can lead to reliability and safety problems.

DETAILED DESCRIPTION OF THE DRAWINGS

The following describes one or more embodiments with reference to the figures, in which like numerals represent the same or similar elements. While the figures are described in terms of the best mode for achieving certain objectives, the description is intended to cover alternatives, modifications, and equivalents as may be included within the spirit and scope of the disclosure.

Figure 1A:
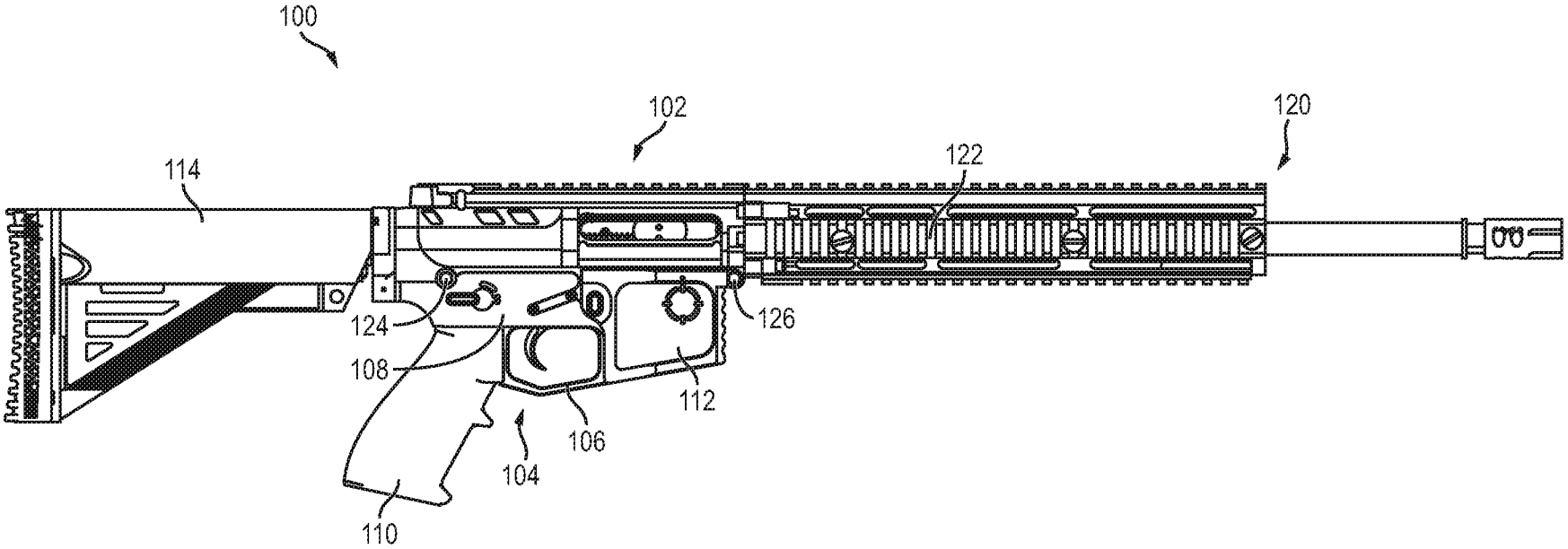
FIG. 1a (PRIOR ART)
FIGS. 1*a*-1*b* illustrate a sporting rifle with conventional upper receiver and lower receiver.
Figure 1B:
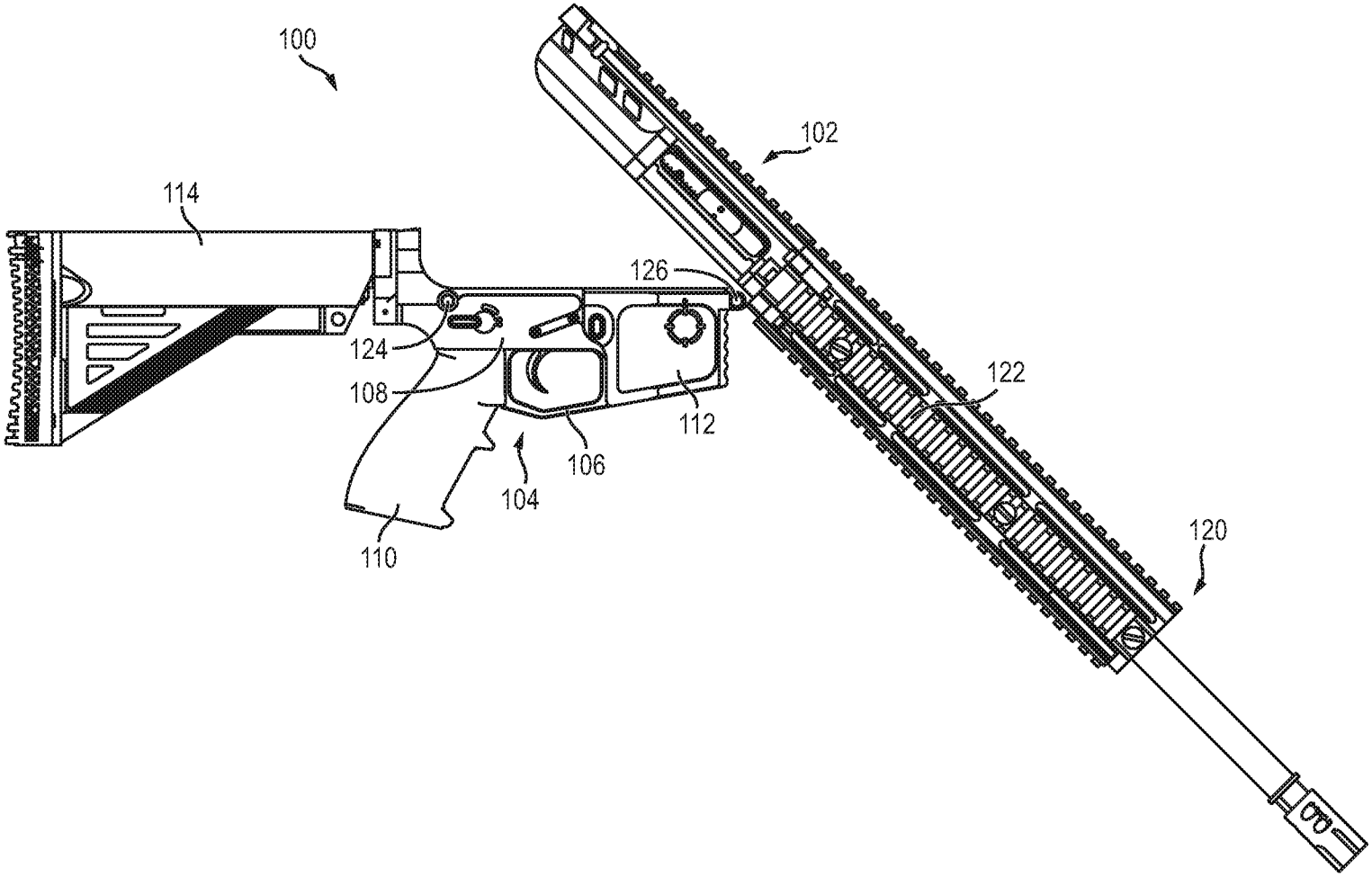
FIG. 1b (PRIOR ART)
Figure 2A:
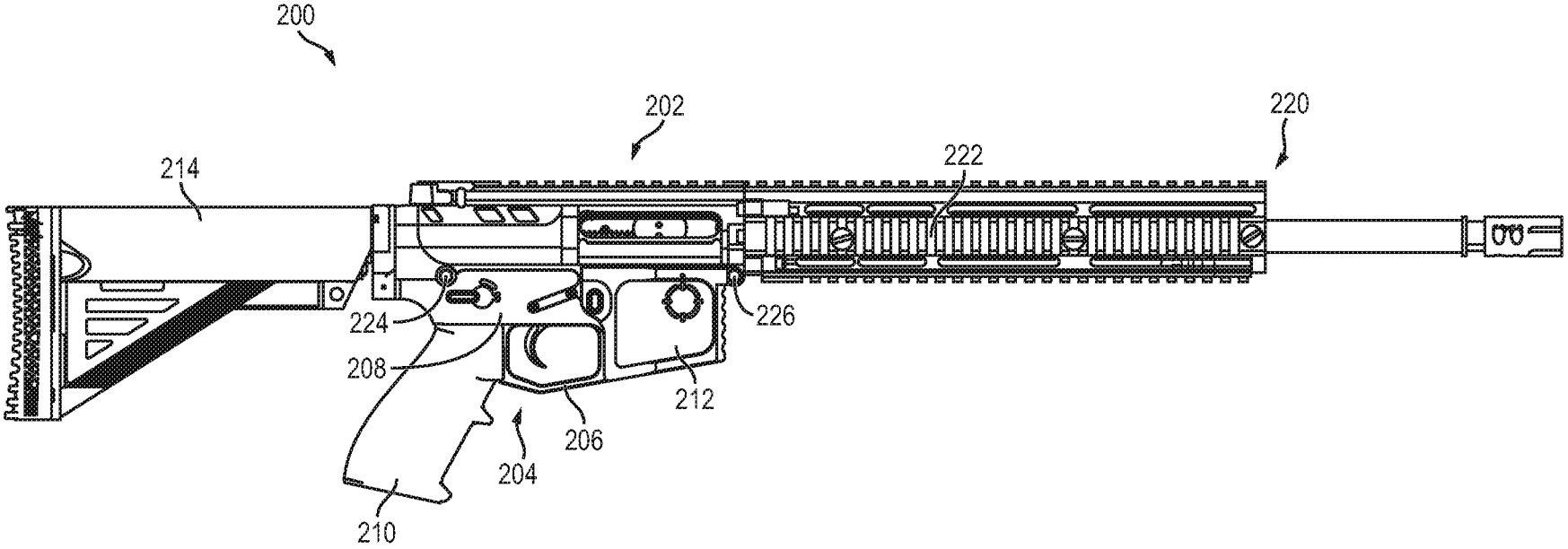
FIGS. 2*a*-2*b* illustrate a sporting rifle with a lower receiver machined to accept an O-ring or linear compression bar.
Figure 2B:
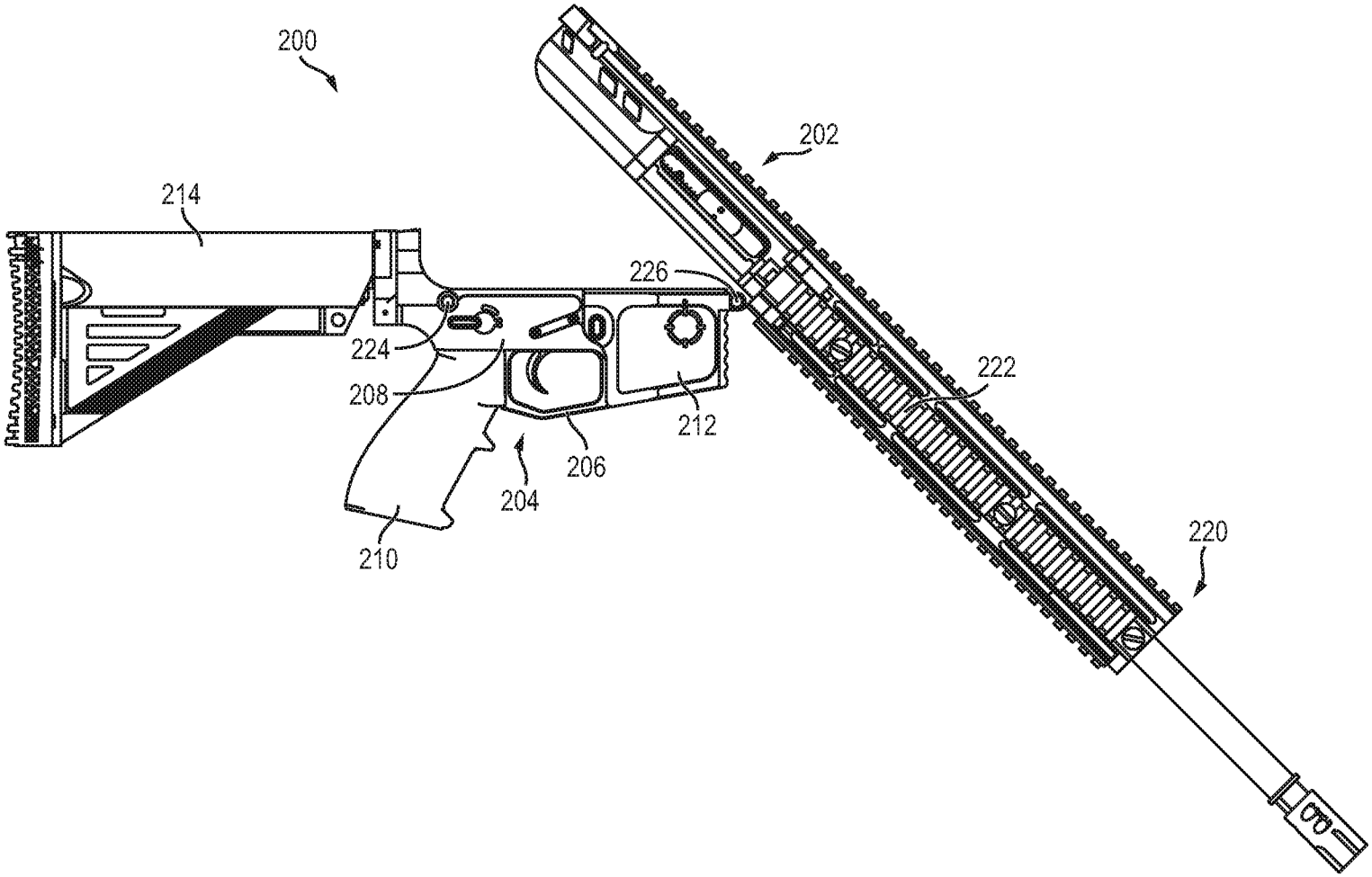

FIG. 2*a* shows an AR-10 or AR-15 sporting rifle 200 designed for modular construction and manufactured for interchangeability of components. Sporting rifle 200 has upper receiver 202, typically forged or casted then computer numerical control (CNC) machined, and lower receiver 204, typically forged or casted then CNC machined. Lower receiver 204 includes trigger guard 206, trigger assembly with hammer 208, pistol grip 210, and magazine well 212. Buttstock 214 attaches to lower receiver 204. Upper receiver 202 includes bolt carrier assembly, forward assist, charging handle, and gas-operated reloader. Barrel assembly 220 with handguard 222 attaches to upper receiver 202. Lower receiver 204 is attached to upper receiver 202 by removable rear take-down pin 224 and forward pivot pin 226. Removing rear take-down pin 224 allows upper receiver 202 to hinge and rotate about forward pivot pin 226, see FIG. 2*b*.

Figure 3A:
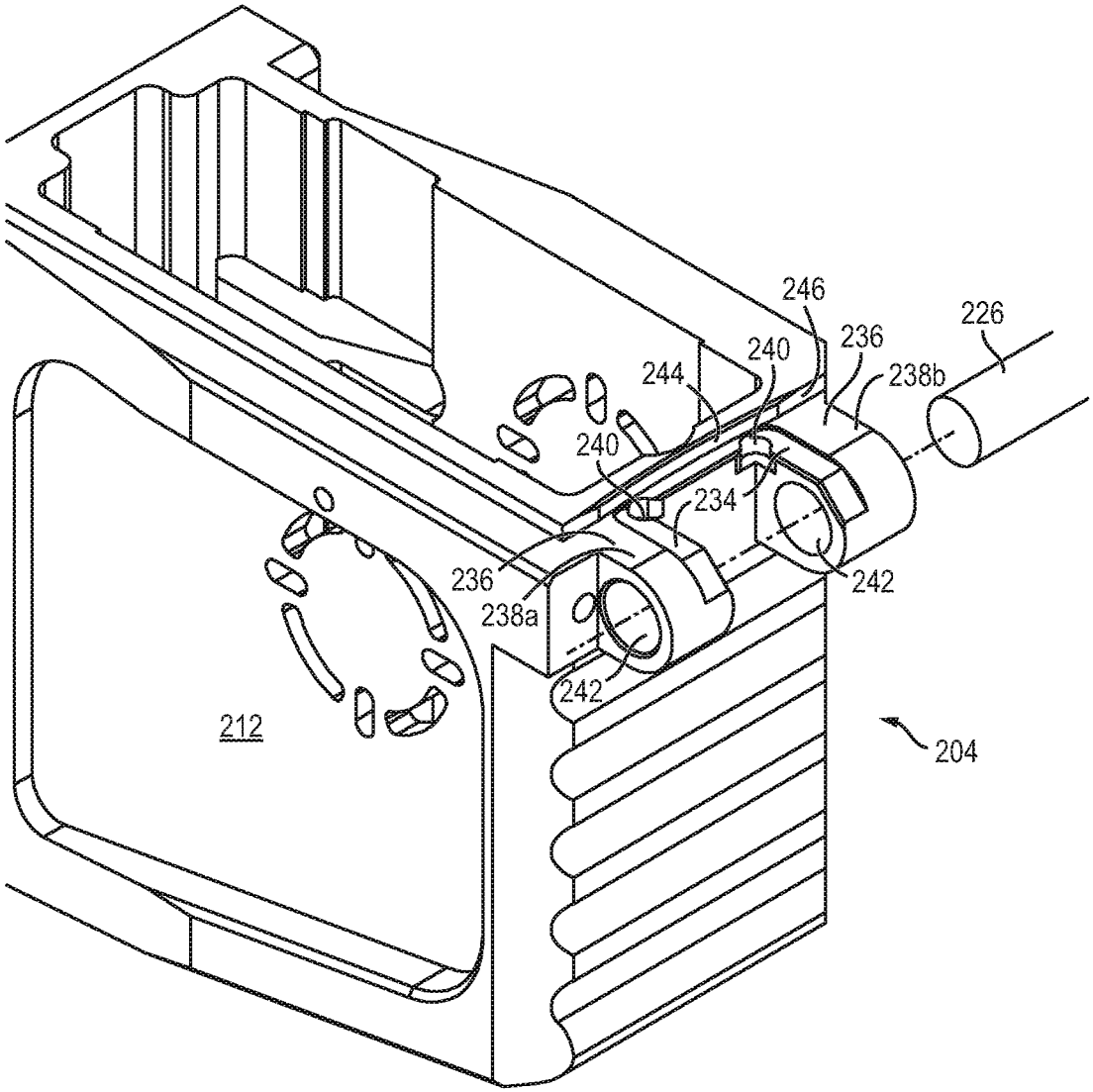
FIGS. 3*a*-3*i* illustrate the upper receiver and lower receiver machined to accept an O-ring.
Figure 3B:
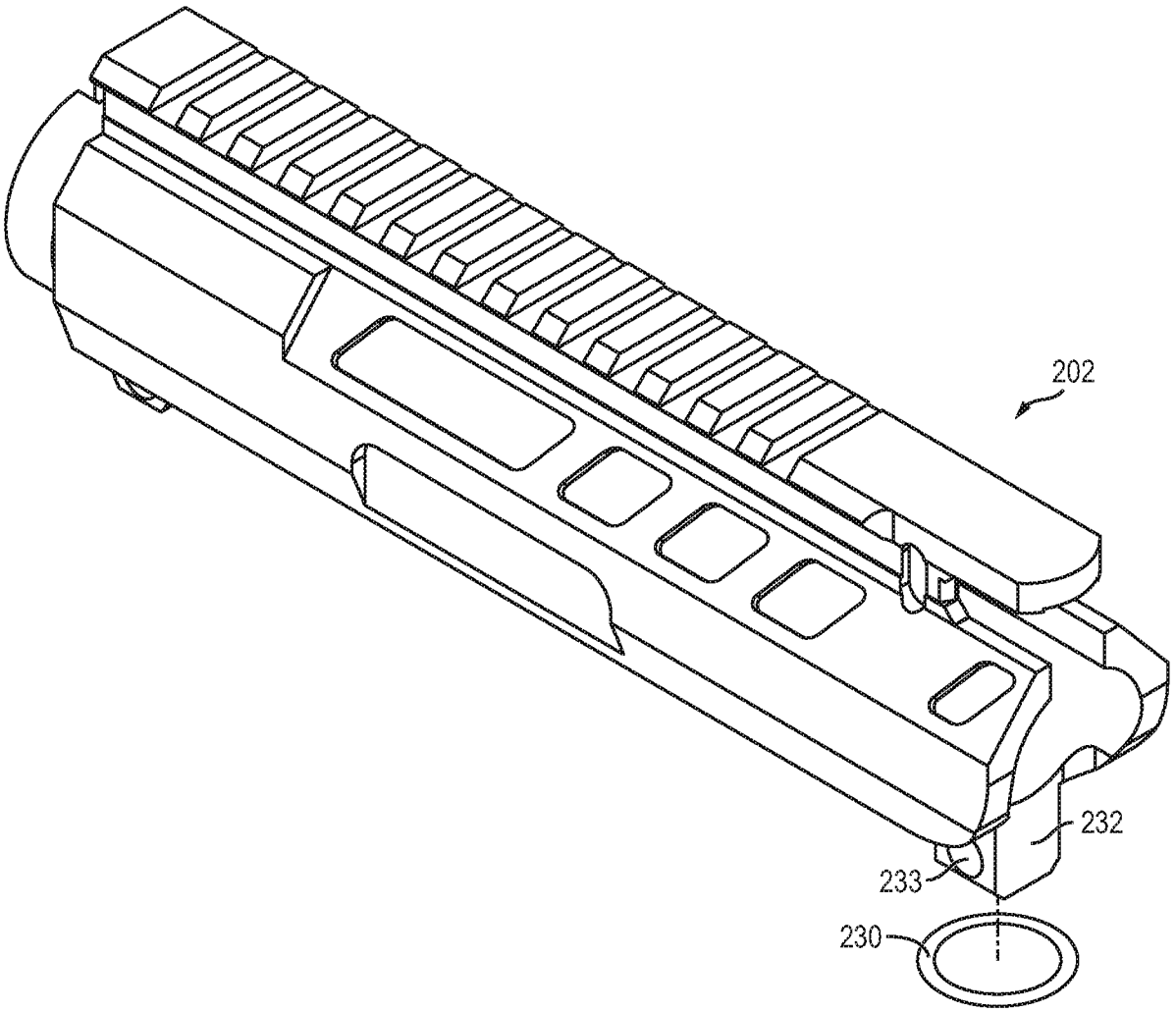
Figure 3C:
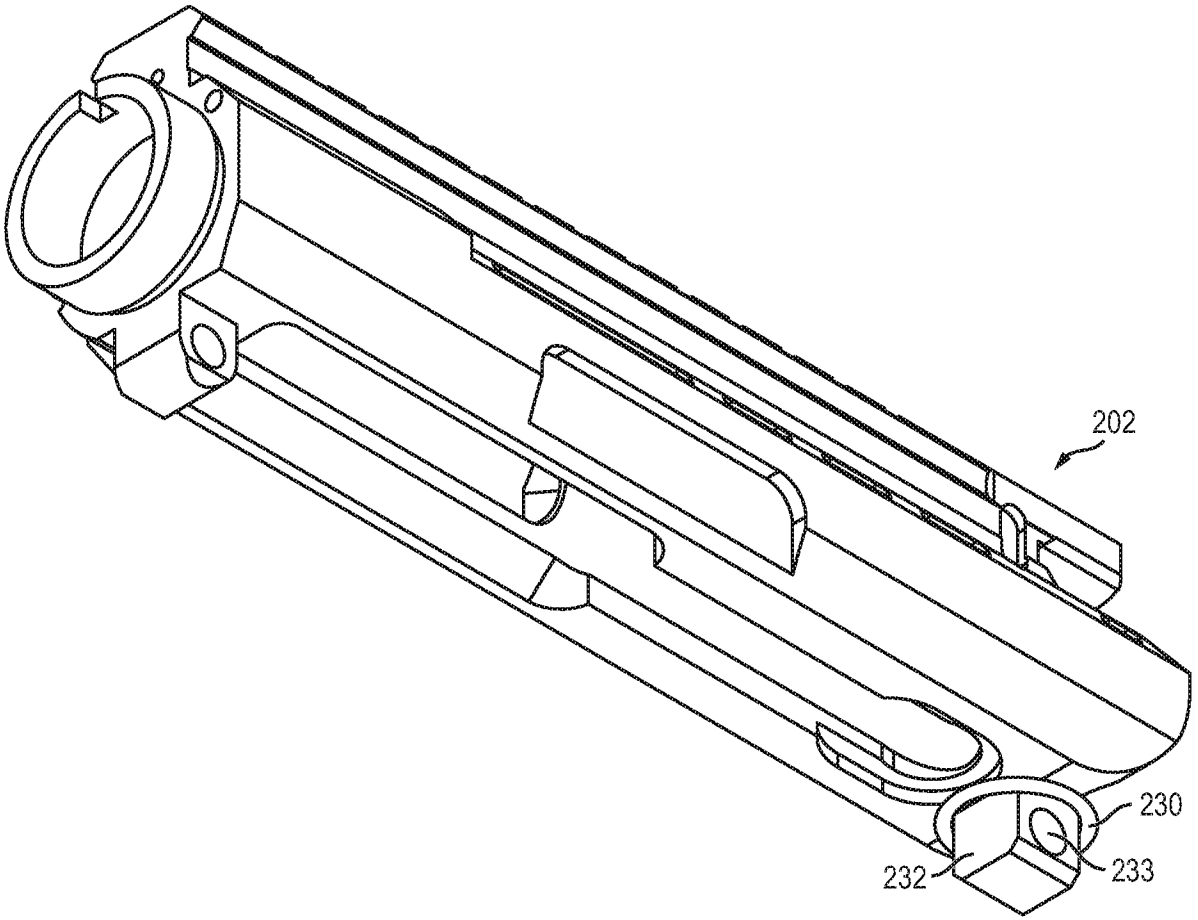

FIG. 3*a* shows further detail of lower receiver 204 machined to accept an O-ring 230. In FIG. 3*b*, O-ring 230 is positioned to be placed around leg 232 of upper receiver 202. Pivot pin O-ring 230 is made with durable, compressible material, such as nitrile, neoprene, silicone, ethylene propylene rubber, ptfe, polyurethane, butadiene rubber, butyl rubber, chlorosulfonated polyethylene, epichlorohydrin rubber, ethylene propylene diene monomer, fluoroelastomer, perfluoroelastomer, polyacrylate rubber, polychloroprene, polyisoprene, polysulfide rubber, polytetrafluoroethylene, sanifluor, thermoplastic elastomer, thermoplastic polyolefin, thermoplastic polyamide, thermoplastic polyurethane, polyether, polyester, rubber, plastic, or foam. In one embodiment, O-ring 230 is a copolymer of tetrafluoroethylene propylene (TFE/P). FIG. 3*c* shows O-ring 230 in place around leg 232 positioned between pivot pin opening 233 and the body of upper receiver 202.

Figure 3D:
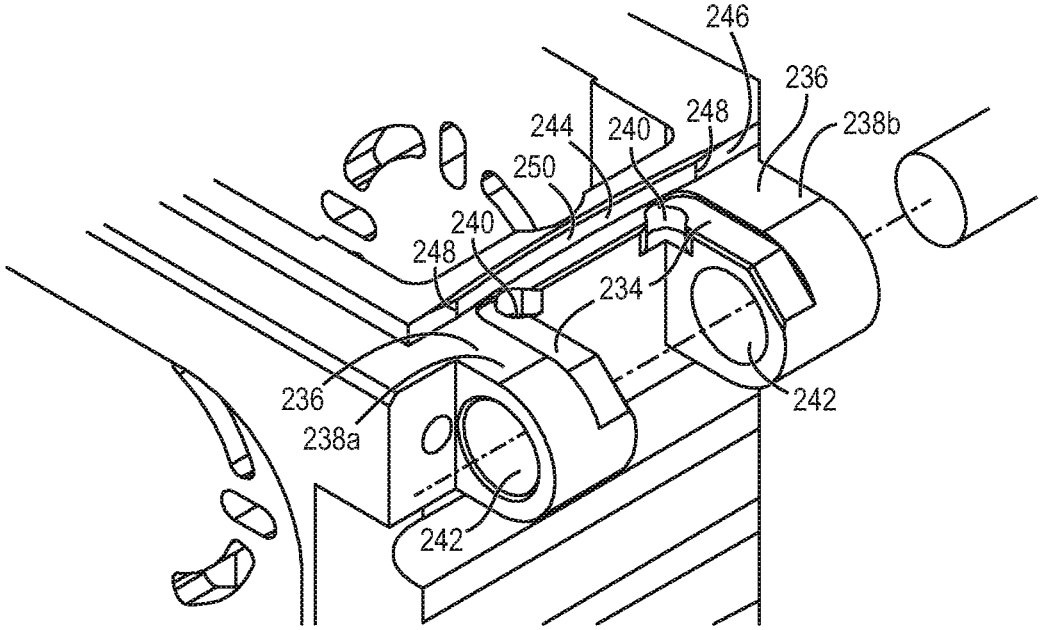
Figure 3E:
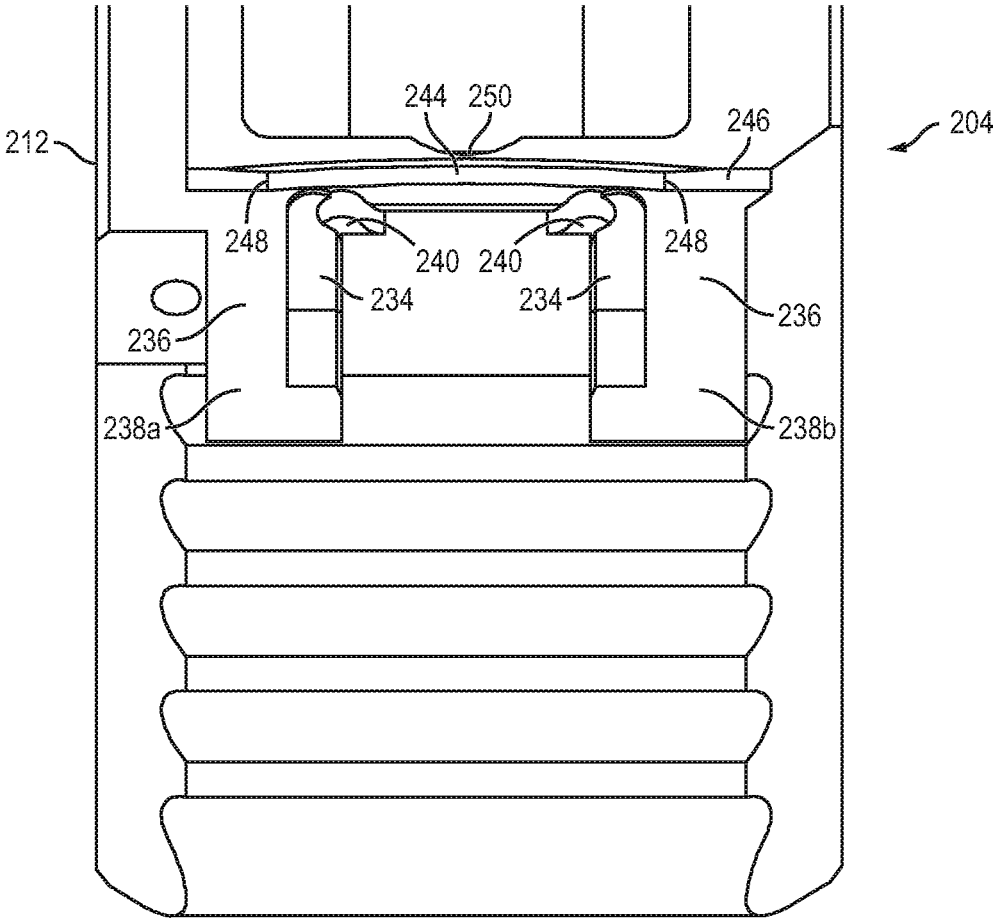

As a feature of lower receiver 204, channels 234 are formed or machined into surface 236 of legs 238*a*-238*b*, as shown in FIG. 3*d*. Channels 234 extend along surface 236 and then angled down the rounded portion of leg 238*a*-238*b*. Recesses 240 are formed or machined partially into the body of lower receiver 204 and partially into legs 238*a*-238*b*. Recesses 240 extend into the body of lower receiver 204 below or deeper than channel 234. Channel 244 is formed into surface 246 of lower receiver 204. Channel 244 is a curved surface from opposing ends 248 with maximum depth at point 250. Channels 234 and 244 and recesses 240 can be formed by CNC machining with a flat 90° End-milling, sinker electrical discharge machining (EDM), and laser cutting. FIG. 3*e* shows a top view of channels 234 and 244 and recesses 240 formed or machined into surface 236 of leg 238*a*-238*b*.

Figure 3F:
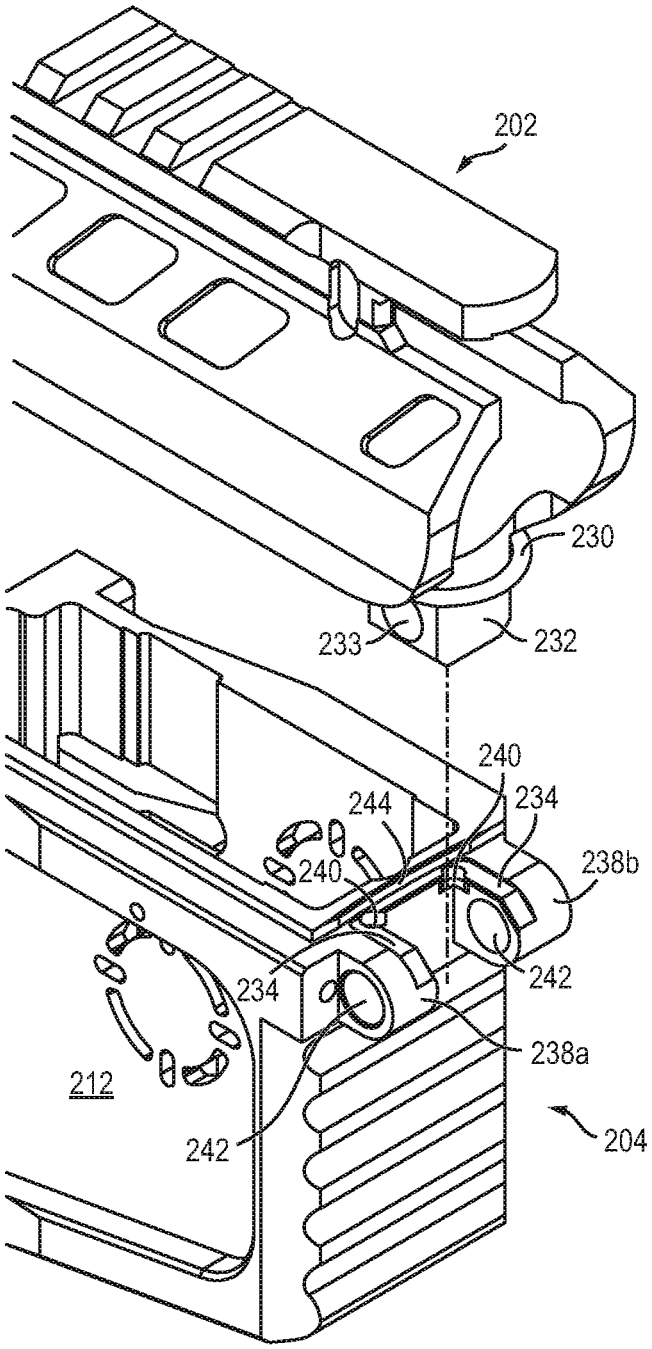
Figure 3G:
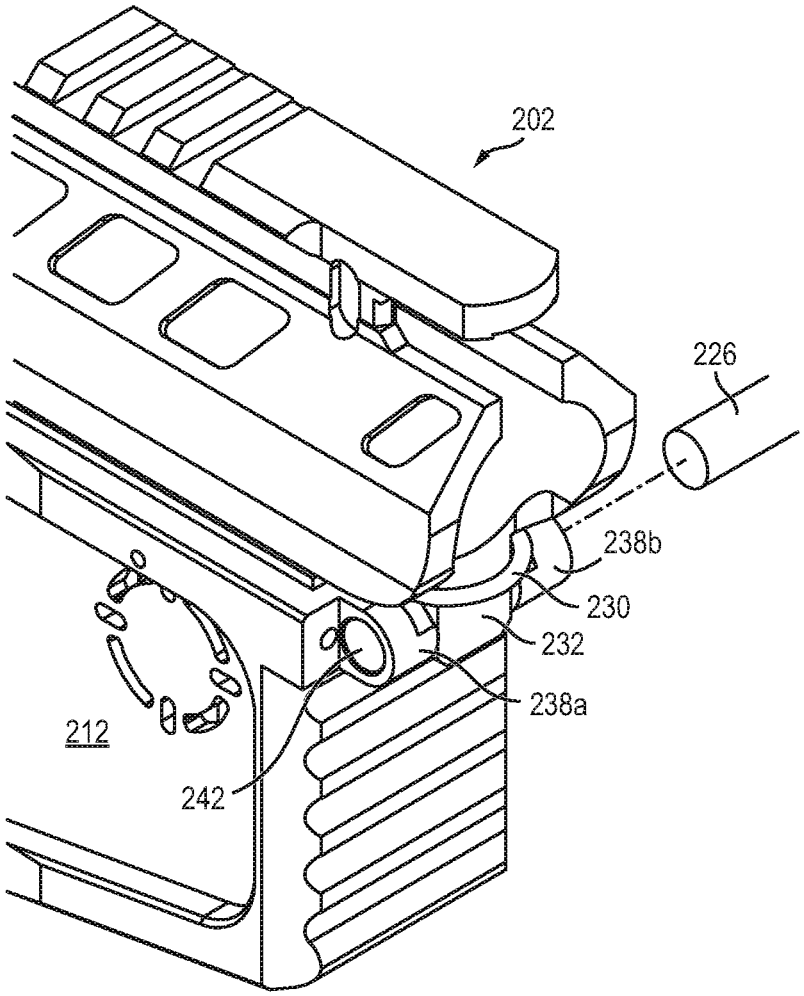
Figure 3H:
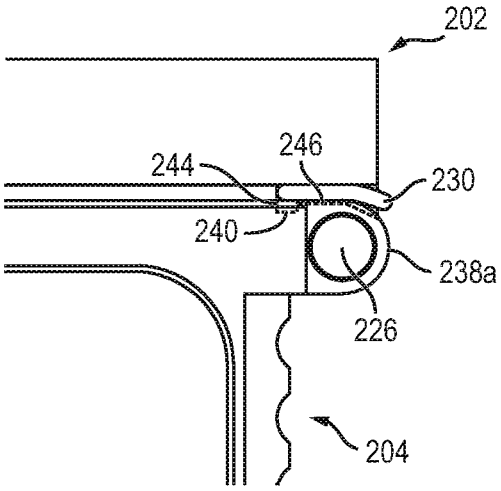
Figure 3I:
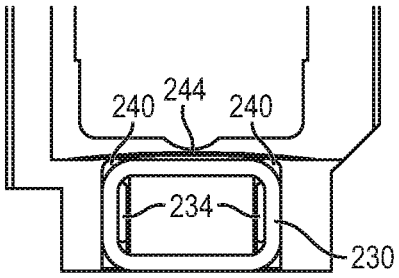

To attach upper receiver 202 onto lower receiver 204, leg 232 with O-ring 230 is aligned between legs 238*a*-238*b* of lower receiver 204, as shown in FIG. 3*f*. FIG. 3*g* shows leg 232 with O-ring 230 disposed between legs 238*a*-238*b* of lower receiver 204. Pivot pin 226 is inserted through openings 242 and opening 233. FIG. 3*h* shows a side view of O-ring 230 disposed in channels 234 and recesses 240. FIG. 3*i* shows a top view of O-ring 230 disposed in channels 234 and recesses 240. The closure between upper receiver 202 to lower receiver 204 compresses O-ring 230 and tightens the fit between the upper receiver and lower receiver, back to the position in FIG. 2*a*. O-ring 230 imposes a pressure (about 1.3-1.8 kg) to hold upper receiver 202 in position relative to lower receiver 204. Channels 234 and 244 provide a groove for expansion, fit, and function of O-ring 230 while reducing shearing and stretching forces that could pinch the O-ring and cause premature wear or breakage. Likewise, recesses 240 reduce shearing stress and stretching forces that could pinch the O-ring and cause premature wear or breakage. O-ring 230 forms and expands to occupy at least a portion of the space within channels 234 and 244 and recesses 240 when compressed. The expansion of O-ring 230 material into channels 234 and 244 and recesses 240 reduces stress, pinching, and abnormal wear areas or patterns on the O-ring. Channels 234 and 244 and recesses 240 reduce occurrences of cutting, breaking, or other damage to O-ring 230 from these shearing stress and stretching forces.

Figure 4:
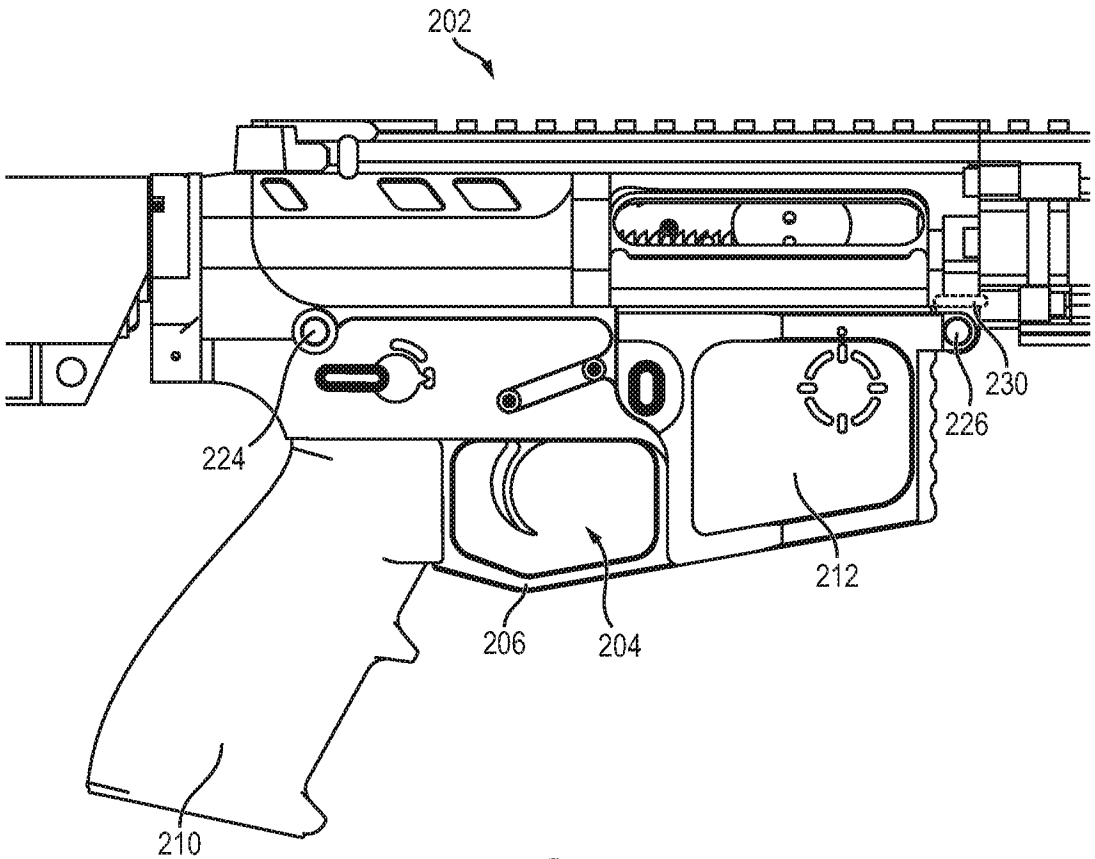
FIG. 4 illustrates the upper receiver mounted to the lower receiver with the O-ring.

FIG. 4 shows upper receiver 202 being held tightly against lower receiver 204 by the compression of O-ring 230. There is less movement between upper receiver 202 and lower receiver 204 which improves fit, function, accuracy, reliability, and durability of Sporting rifle 200. O-ring 230 makes the firearm more accurate by zeroing the tolerances. The flexibility of O-ring 230 compresses the tolerances and removes wobbling (misfit) between upper receiver 202 and lower receiver 204, while allowing free assembly and disassembly of sporting rifle 200. If the lower and the upper receivers are manufactured within +/−0.002 of the original-design geometry, the stack-up tolerances will be within +/−0.004 range. These tolerances are acceptable by the original-design, but affects the accuracy of sporting rifle 200. On the other hand, if a manufacturer falls outside of the allowable tolerances, the wobbling (misfit) will be become more noticeable which will affect the accuracy and the reliability of sporting rifle 200. The compression of O-ring 230 within channels 234 and 244 and recess 240 remove these tolerances after assembly, but allow for the mechanical relationship between upper receiver 202 and lower receiver 204 during disassembly.

Figure 5A:
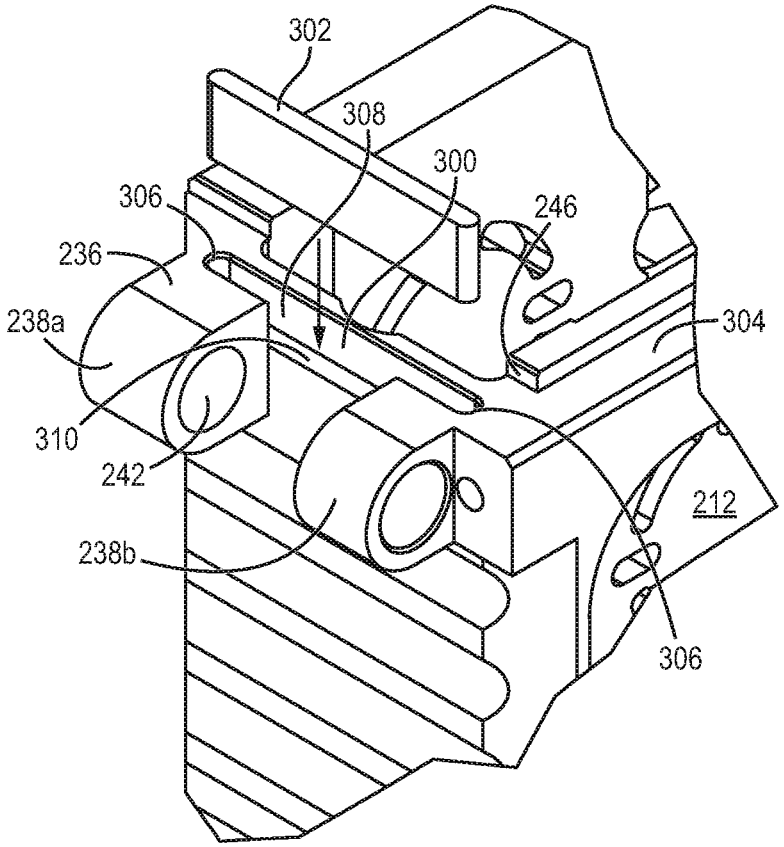
FIGS. 5*a*-5*g* illustrate the upper receiver and lower receiver machined to accept a linear compression bar.
Figure 5B:
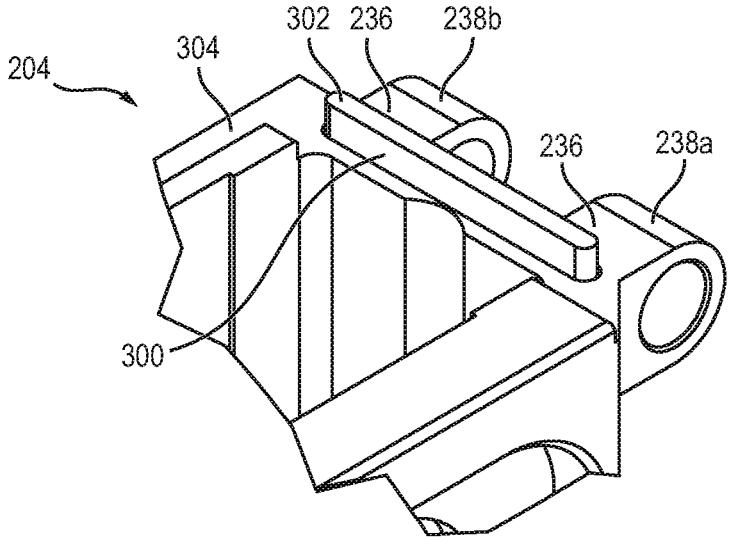

In another embodiment, FIG. 5*a* shows further detail of lower receiver 204 machined with slot or recess 300 to accept linear compression bar 302 or other compressible material. Elements having the same reference number perform a similar function as in FIGS. 3*a*-3*i*. Linear compression bar 302 is positioned and aligned to be placed in slot 300 of lower receiver 204. Linear compression bar 302 is made with durable, compressible, anti-abrasive, and heat resistant material, such as nitrile, neoprene, silicone, ethylene propylene rubber, ptfe, polyurethane, butadiene rubber, butyl rubber, chlorosulfonated polyethylene, epichlorohydrin rubber, ethylene propylene diene monomer, fluoroelastomer, perfluoroelastomer, polyacrylate rubber, polychloroprene, polyisoprene, polysulfide rubber, polytetrafluoroethylene, sanifluor, thermoplastic elastomer, thermoplastic polyolefin, thermoplastic polyamide, thermoplastic polyurethane, polyether, polyester, rubber, plastic, or foam. In one embodiment, linear compression bar 302 is a copolymer of TFE/P. Alternatively, linear compression bar 302 is a sheet spring. FIG. 5*b* shows linear compression bar 302 in place, partially within slot 300. A portion of linear compression bar 302 extends above surface 304 of lower receiver 204.

Figure 5C:
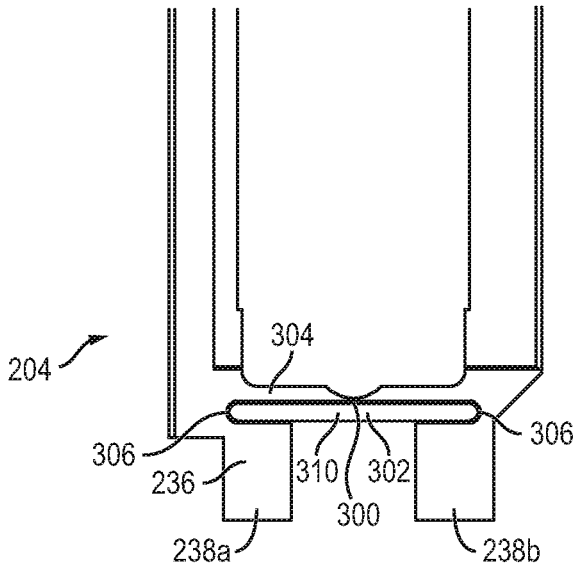

As a feature of lower receiver 204, slot 300 is formed or machined into surfaces 236 and 304, as shown in FIG. 5*a*. Slot 300 includes rounded ends 306 and vertical wall 308 extending from bottom surface 310 of the slot to surface 304. Slot 300 can be formed by CNC machining with a flat 90° End-milling, sinker EDM, and laser cutting. FIG. 5*c* shows a top view of linear compression bar 302 disposed in slot 300 of lower receiver 204.

Figure 5D:
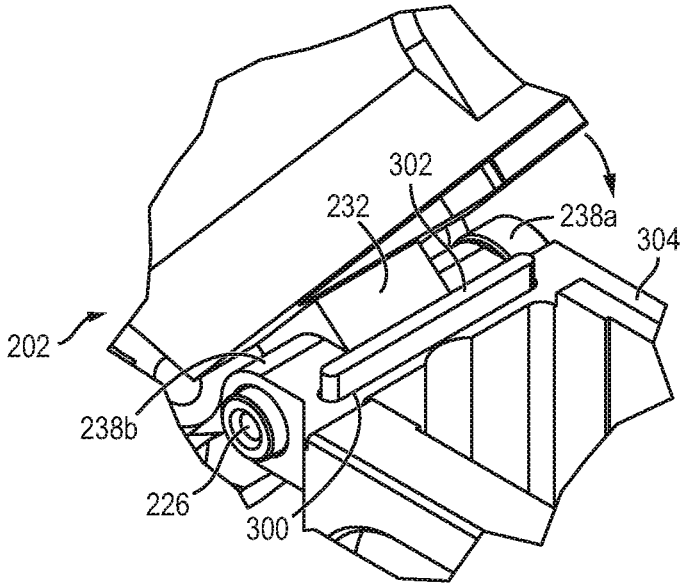
Figure 5E:
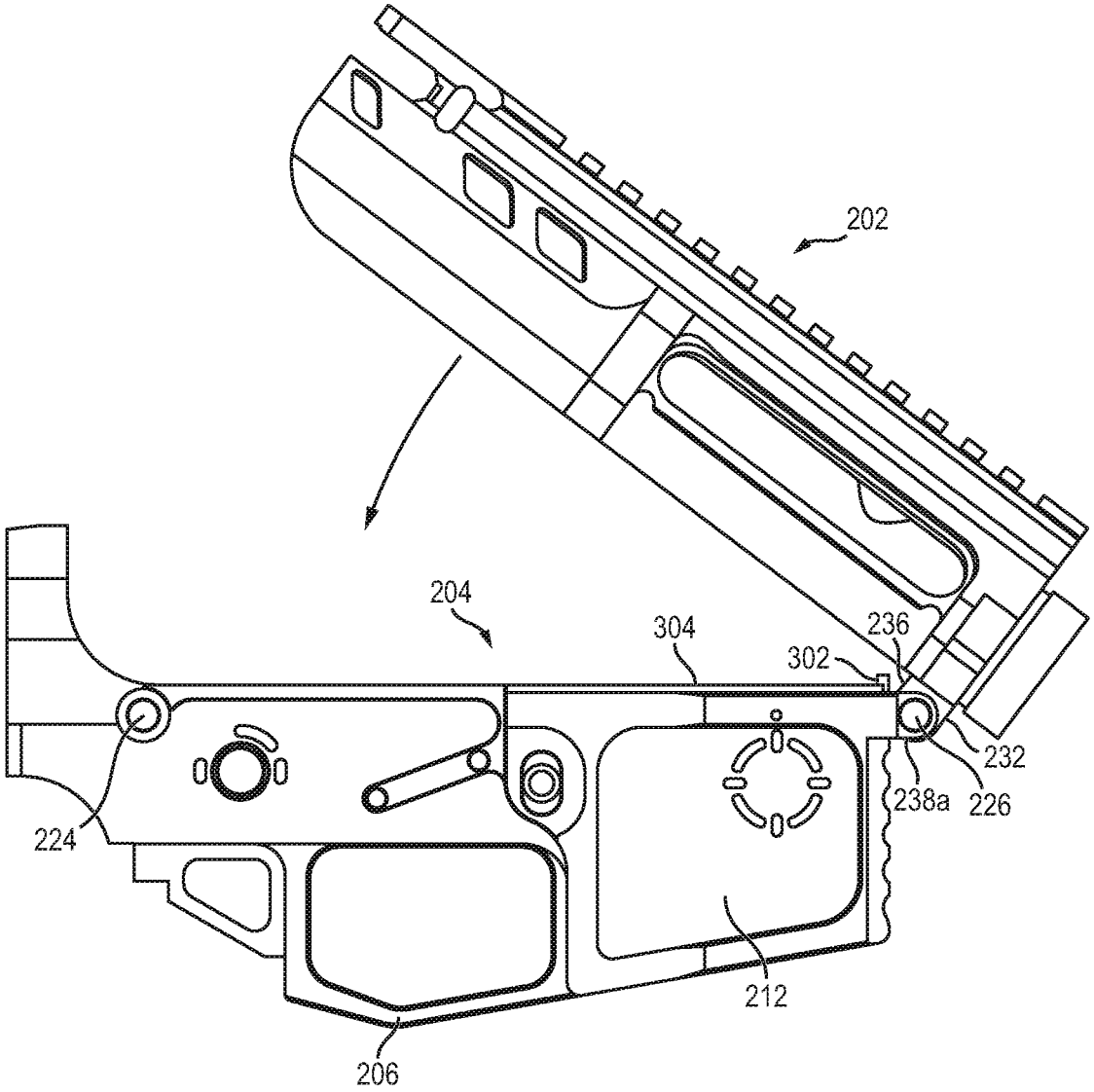

FIG. 5*d* shows leg 232 of upper receiver 202 disposed between legs 238*a*-238*b* of lower receiver 204. Pivot pin 226 is inserted through openings 242 and opening 233. FIG. 5*e* shows a side view of linear compression bar 302 disposed in slot 300 of lower receiver 204 in a relaxed state, i.e., without stretching or otherwise manipulated to fit into the slot. Linear compression bar 302 can be secured within slot 300 with an adhesive that is robust against solvents to stabilize the linear compression bar during operation and cleaning of Sporting rifle 200.

Figure 5F:
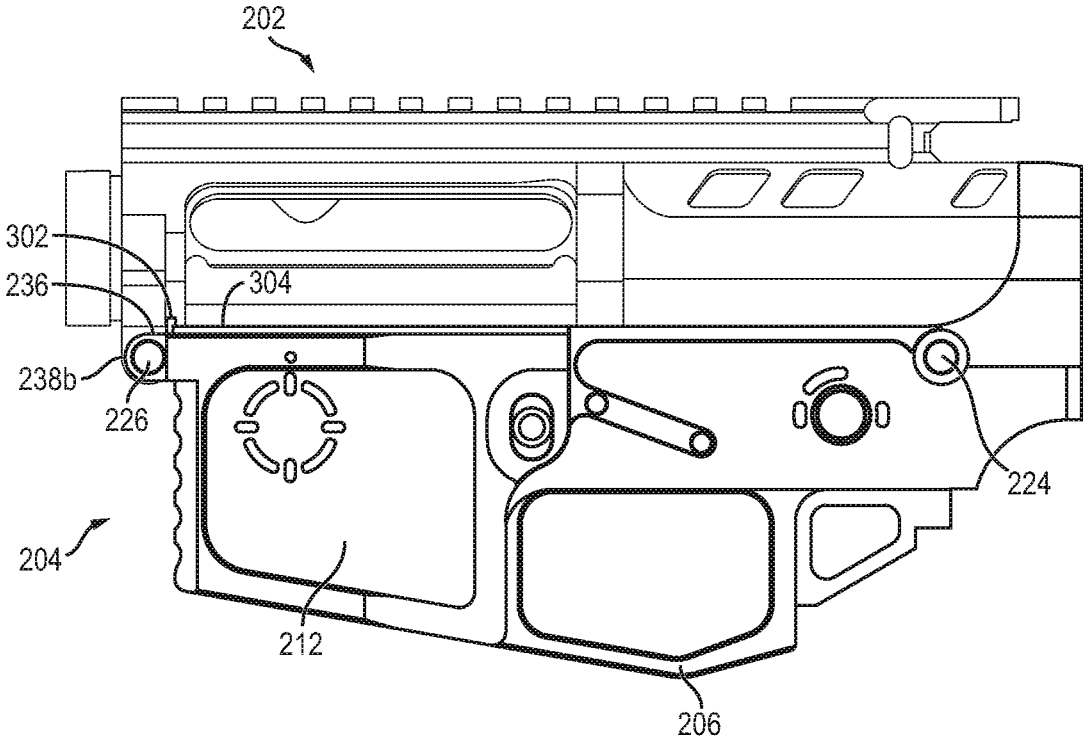
Figure 5G:
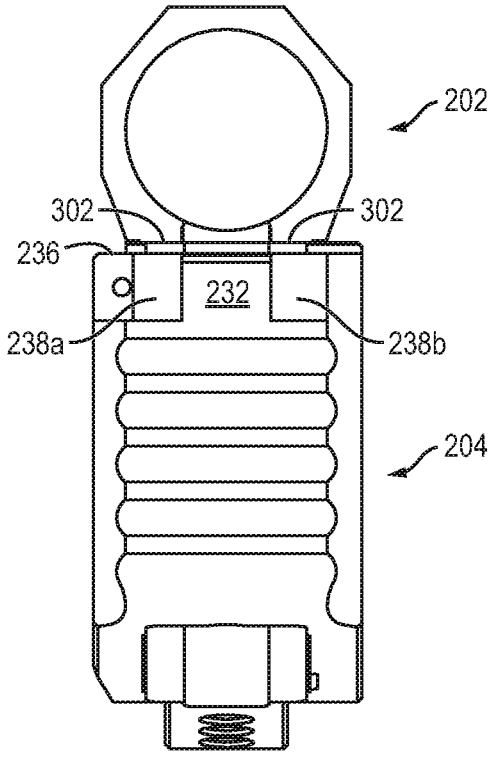

In FIG. 5*f*, the closure between upper receiver 202 to lower receiver 204 compresses linear compression bar 302 inside a closed profile and tightens the fit between the upper receiver and lower receiver, back to the position in FIG. 2*a*. Linear compression bar 302 imposes a pressure (about 1.3-1.8 kg) to hold upper receiver 202 in position relative to lower receiver 204, see FIG. 5*g*. Slot 300 provides space for expansion, fit, and function of linear compression bar 302 while reducing shearing and stretching forces that could pinch the linear compression bar and cause premature wear or breakage. Vertical surface 308 and slot 300 support linear compression bar 302 to prevent collapse, bending, or buckling under compression. Likewise, slot 300 reduces shearing stress and stretching forces that could pinch the linear compression bar and cause premature wear or breakage. Linear compression bar 302 forms and expands to occupy at least a portion of the space within slot 300 when compressed. The expansion of linear compression bar 302 material into slot 300 reduces stress, pinching, and abnormal wear areas or patterns on the linear compression bar. Slot 300 reduces occurrences of cutting, breaking, or other damage to linear compression bar 302 from these shearing stress and stretching forces.

Figure 6:
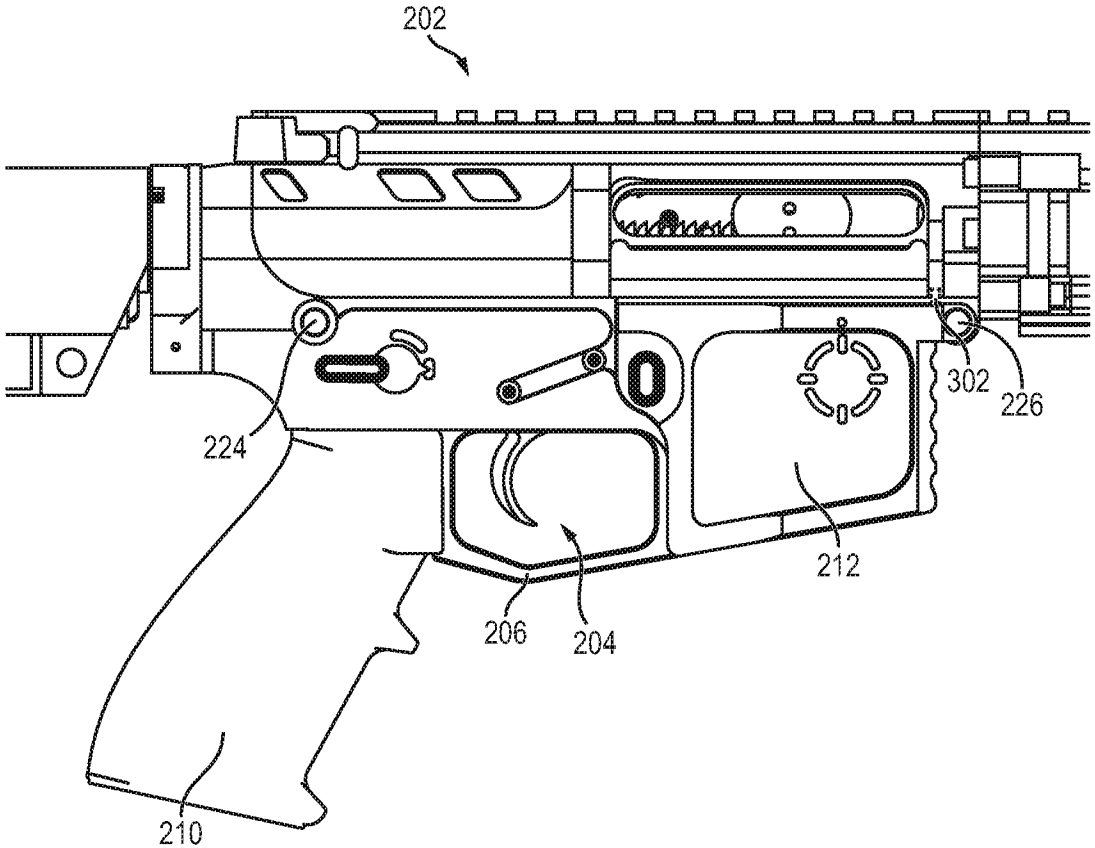
FIG. 6 illustrates the upper receiver mounted to the lower receiver with the linear compression bar.

FIG. 6 shows upper receiver 202 being held tightly against lower receiver 204 by the compression of linear compression bar 302. There is less movement between upper receiver 202 and lower receiver 204 which improves fit, function, accuracy, reliability, and durability of Sporting rifle 200. Linear compression bar 302 is readily replaceable by lifting upper receiver 202 from lower receiver 204. Linear compression bar 302 makes the firearm more accurate by zeroing the tolerances. The flexibility of linear compression bar 302 compresses the tolerances and removes wobbling (misfit) between upper receiver 202 and lower receiver 204, while allowing free assembly and disassembly of sporting rifle 200. If the lower and the upper receivers are manufactured within +/−0.002 of the original-design geometry, the stack-up tolerances will be within +/−0.004 range. These tolerances are acceptable by the original-design, but affects the accuracy of sporting rifle 200. On the other hand, if a manufacturer falls outside of the allowable tolerances, the wobbling (misfit) will be become more noticeable which will affect the accuracy and the reliability of sporting rifle 200. The compression of linear compression bar 302 within slot 300 removes these tolerances after assembly, but allow for the mechanical relationship between upper receiver 202 and lower receiver 204 during disassembly.

While one or more embodiments have been illustrated and described in detail, the skilled artisan will appreciate that modifications and adaptations to those embodiments may be made without departing from the scope of the present disclosure.

What is claimed:

1. A firearm, comprising:

a lower receiver with pivot pin legs and an elongated slot formed in a surface of the lower receiver along the pivot pin legs;

an upper receiver attached to the lower receiver at a pivot point; and a compressible material disposed within the elongated slot between the upper receiver and lower receiver to substantially fill the elongated slot with a flat top surface of the compressible material extending above the elongated slot.

2. The firearm of claim 1, wherein the elongated slot includes a rounded end.

3. The firearm of claim 1, wherein the compressible material includes a linear compression bar.

4. The firearm of claim 1, wherein the compressible material extends above the surface of the lower receiver.

5. A firearm, comprising:

a lower receiver with pivot pin legs and an elongated slot with rounded ends formed in a surface of the lower receiver along the pivot pin legs; and a compressible material disposed within the elongated slot to substantially fill the elongated slot with a flat top surface of the compressible material extending above the elongated slot.

6. The firearm of claim 5, further including an upper receiver attached to the lower receiver at a pivot point, wherein the upper receiver compresses the compressible material when the upper receiver closes onto the lower receiver.

7. The firearm of claim 5, wherein the elongated slot includes a bottom surface and vertical surface extending from the bottom surface to the surface of the lower receiver.

8. The firearm of claim 5, wherein the compressible material includes a linear compression bar.

9. The firearm of claim 5, wherein the compressible material extends above the surface of the lower receiver.

10. The firearm of claim 5, wherein the compressible material includes a copolymer of tetrafluoroethylene propylene.

11. A method of making a firearm, comprising:

providing a lower receiver with pivot pin legs;

forming an elongated slot in a surface of the lower receiver along the pivot pin legs; and disposing a compressible material within the elongated slot to substantially fill the elongated slot with a flat top surface of the compressible material extending above the elongated slot.

12. The method of claim 11, further including attaching an upper receiver to the lower receiver at a pivot point, wherein the upper receiver compresses the compressible material when the upper receiver closes onto the lower receiver.

13. The method of claim 11, wherein the elongated slot includes a bottom surface and vertical surface extending from the bottom surface to the surface of the lower receiver.

14. The method of claim 11, wherein the elongated slot includes a rounded end.

15. The method of claim 11, wherein the compressible material includes a linear compression bar.

16. The method of claim 11, wherein the compressible material extends above the surface of the lower receiver.

17. The method of claim 11, wherein the compressible material includes a copolymer of tetrafluoroethylene propylene.

* * * * *